US008219016B2

(12) United States Patent
Hasegawa et al.

(10) Patent No.: US 8,219,016 B2
(45) Date of Patent: Jul. 10, 2012

(54) FIXING DEVICE AND IMAGE FORMING APPARATUS INCORPORATING SAME

(75) Inventors: Kenichi Hasegawa, Atsugi (JP); Akira Shinshi, Machida (JP); Hiroshi Yoshinaga, Ichikawa (JP); Yoshiki Yamaguchi, Sagamihara (JP); Yutaka Ikebuchi, Ebina (JP); Ippei Fujimoto, Yokohama (JP); Shuntaroh Tamaki, Kawasaki (JP); Toshihiko Shimokawa, Zama (JP); Naoki Iwaya, Chofu (JP)

(73) Assignee: Ricoh Company, Limited, Tokyo (JP)

( * ) Notice: Subject to any disclaimer, the term of this patent is extended or adjusted under 35 U.S.C. 154(b) by 223 days.

(21) Appl. No.: 12/780,309

(22) Filed: May 14, 2010

(65) Prior Publication Data

US 2010/0290822 A1 Nov. 18, 2010

(30) Foreign Application Priority Data

May 15, 2009 (JP) ..... 2009-118513
Jan. 15, 2010 (JP) ..... 2010-006730

(51) Int. Cl.
*G03G 15/20* (2006.01)

(52) U.S. Cl. ..... 399/329; 399/122

(58) Field of Classification Search ..... 399/107, 399/110, 122, 320, 328, 329; 219/216, 619
See application file for complete search history.

(56) References Cited

U.S. PATENT DOCUMENTS 7,630,652 B2 12/2009 Hasegawa
7,702,271 B2 4/2010 Yamada et al.
2007/0201914 A1* 8/2007 Tsuji et al. ..... 399/328
2007/0292175 A1 12/2007 Shinshi
2008/0063443 A1 3/2008 Yoshinaga et al.
2008/0112739 A1 5/2008 Shinshi
2008/0175633 A1 7/2008 Shinshi
2008/0219730 A1 9/2008 Shinshi
2008/0253788 A1 10/2008 Shinshi
2008/0298862 A1 12/2008 Shinshi
2009/0003867 A1 1/2009 Fujimoto
2009/0067902 A1 3/2009 Yoshinaga et al.
2009/0123201 A1 5/2009 Ehara et al.
2009/0123202 A1 5/2009 Yoshinaga et al.
2009/0148204 A1 6/2009 Yoshinaga et al.
2009/0169232 A1 7/2009 Kunii et al.
2009/0245865 A1 10/2009 Shinshi et al.
2009/0311016 A1 12/2009 Shinshi
2010/0074667 A1 3/2010 Ehara et al.
2010/0092220 A1 4/2010 Hasegawa et al.
2010/0092221 A1 4/2010 Shinshi et al.

FOREIGN PATENT DOCUMENTS

JP 2008-146010 6/2008
JP 2008-158482 7/2008

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A fixing device includes a hollow, generally cylindrical open-sided stationary heat roll, a flexible fuser belt, a fuser pad, a rotatable pressure member, and a roll shape retainer. The heat roll is configured to heat an outer circumference thereof, and defines an elongated longitudinal side opening in one side thereof. The fuser belt is looped for rotation around the heat roll to transfer heat radially outward from the roll circumference. The fuser pad is held substantially stationary along the roll opening outward from the roll hollow and inward from the loop of the fuser belt. The pressure member is pressed against the fuser pad through the fuser belt to form a fixing nip. The roll shape retainer is disposed on the roll opening to retain the generally cylindrical shape of the heat roll.

19 Claims, 9 Drawing Sheets

FIXING DEVICE AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application Nos. 2009-118513 and 2010-006730, filed on May 15, 2009 and Jan. 15, 2010, respectively, which are hereby incorporated by reference herein in their entirety.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile, printer, plotter, or multifunctional machine incorporating several of those imaging functions, incorporating such a fixing device.

2. Discussion of the Background

In electrophotographic image forming apparatus, such as photocopiers, facsimiles, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner with heat and pressure.

Various types of fixing devices are known in the art, most of which employ a pair of generally cylindrical fixing members, one being heated for fusing toner ("fuser member") and the other being pressed against the heated one ("pressure member"), which together form a heated area of contact called a fixing nip.

One specific type of fuser employed in the fixing device is an endless belt looped for rotation around a stationary pipe of thermally conductive metal internally heated with a heater accommodated within its hollow interior. As the fuser belt rotates, the metal pipe conducts heat from inside to its outer circumference, which then transfers heat to the length of the rotating belt. Using the internally heated metal pipe allows for heating the fuser belt swiftly and uniformly, resulting in short periods of warm-up time and first print time required to complete an initial print job upon startup, and high immunity against printing failures caused by insufficiently heating of the fuser member in high speed application.

Various methods have been proposed to provide a stable, efficient structure for a fuser assembly employing a fuser belt looped around a heat pipe.

For example, one conventional fixing device employs a generally cylindrical, open-sided heat pipe formed by bending a sheet of thermally conductive material into a rolled configuration with a substantially C-shaped cross-section, around which a fuser belt is looped for rotation. According to this method, the heat pipe has a separate fuser pad held stationary in its side opening, outside the pipe hollow and inside the belt loop, with adequate spacing left between adjoining surfaces of the heat pipe and the fuser pad. In use, the heat pipe is disposed with the open side facing a rotatable pressure member, which is pressed against the fuser pad through the fuser belt to form a fixing nip.

Another conventional method also proposes a similar open-sided heat pipe with a fuser belt looped therearound and a separate fuser pad accommodated in the pipe opening, which is additionally equipped with a reinforcing member held stationary inside the heat pipe to strengthen and support the fuser pad subjected to pressure from a pressure member.

Using the open-sided heat pipe in combination with the fuser pad allows for high mechanical stability of the fuser assembly, since it enables the heat pipe to operate in isolation from pressure from the pressure member, which can thus maintain its generally cylindrical configuration without bending or bowing away from the fixing nip. Such protection against deformation is particularly important where the heat pipe is thin-walled to obtain high thermal efficiency in the fixing device. Mechanical stability of the open-sided fuser assembly is enhanced by adding reinforcement to the fuser pad, which ensures consistent contact between the fuser pad and the pressure member to maintain uniform distribution of pressure across the fixing nip One problem encountered when using the open-sided heat pipe is that the heat pipe tends to lose its generally cylindrical shape, with the gap between the opening edges widened to deform the C-shaped cross-section. Such deformation is attributed to elastic recovery of the roll material after bending, known in the art as "springback", and tends to occur at the longitudinal center rather than the longitudinal ends of the heat pipe which are typically fastened to a frame or support of the fixing device. The effects of elastic recovery are unacceptable where the heat pipe is formed of an extremely thin sheet of material for obtaining maximum thermal efficiency.

If not corrected, deformation of the heat roll can cause various defects due to interference or mis-coordination between the fuser belt and the heat roll, such as the belt getting damaged or making noise by excessively rubbing against the fuser roll, or running out of track by slipping off the roll surface.

SUMMARY OF THE INVENTION

Exemplary aspects of the present invention are put forward in view of the above-described circumstances, and provide a novel fixing device that fixes a toner image in place on a recording medium.

In one exemplary embodiment, the novel fixing device includes a hollow, generally cylindrical open-sided stationary heat roll, a flexible fuser belt, a fuser pad, a rotatable pressure member, and a roll shape retainer. The heat roll is configured to heat an outer circumference thereof, and defines an elongated side opening in one side thereof. The fuser belt is looped for rotation around the heat roll to transfer heat radially outward from the roll circumference. The fuser pad is held substantially stationary along the roll opening outward from the roll hollow and inward from the loop of the fuser belt. The pressure member is pressed against the fuser pad through the fuser belt to form a fixing nip through which a recording medium is passed to fix a toner image under heat and pressure. The roll shape retainer is disposed on the roll opening to retain the generally cylindrical shape of the heat roll.

In another exemplary embodiment, the fixing device includes a hollow, partially open-sided stationary heat roll, a flexible fuser belt, a fuser pad, a rotatable pressure member, and a reinforcing member. The heat roll is configured to heat an outer circumference of the heat roll, and is at least partially open to define a series of one or more side openings in one side thereof. The fuser belt is looped for rotation around the heat roll to transfer heat radially outward from the roll circumference. The fuser pad is held substantially stationary along the series of roll openings outward from the roll hollow and inward from the loop of the fuser belt. The pressure member is pressed against the fuser pad through the fuser belt to form a fixing nip through which a recording medium is passed to fix a toner image under heat and pressure. The reinforcing member is disposed within the roll hollow to thrust against the fuser pad through the series of roll openings for reinforcement.

Other exemplary aspects of the present invention are put forward in view of the above-described circumstances, and provide a novel image forming apparatus.

In one exemplary embodiment, the image forming apparatus includes an electrophotographic mechanism and a fixing unit. The electrophotographic imaging unit forms a toner image on a recording medium. The fixing device includes a hollow, generally cylindrical open-sided stationary heat roll, a flexible fuser belt, a fuser pad, a rotatable pressure member, and a roll shape retainer. The heat roll is configured to heat an outer circumference thereof, and defines an elongated side opening in one side thereof. The fuser belt is looped for rotation around the heat roll to transfer heat radially outward from the roll circumference. The fuser pad is held substantially stationary along the roll opening outward from the roll hollow and inward from the loop of the fuser belt. The pressure member is pressed against the fuser pad through the fuser belt to form a fixing nip through which a recording medium is passed to fix a toner image under heat and pressure. The roll shape retainer is disposed on the roll opening to retain the generally cylindrical shape of the heat roll.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
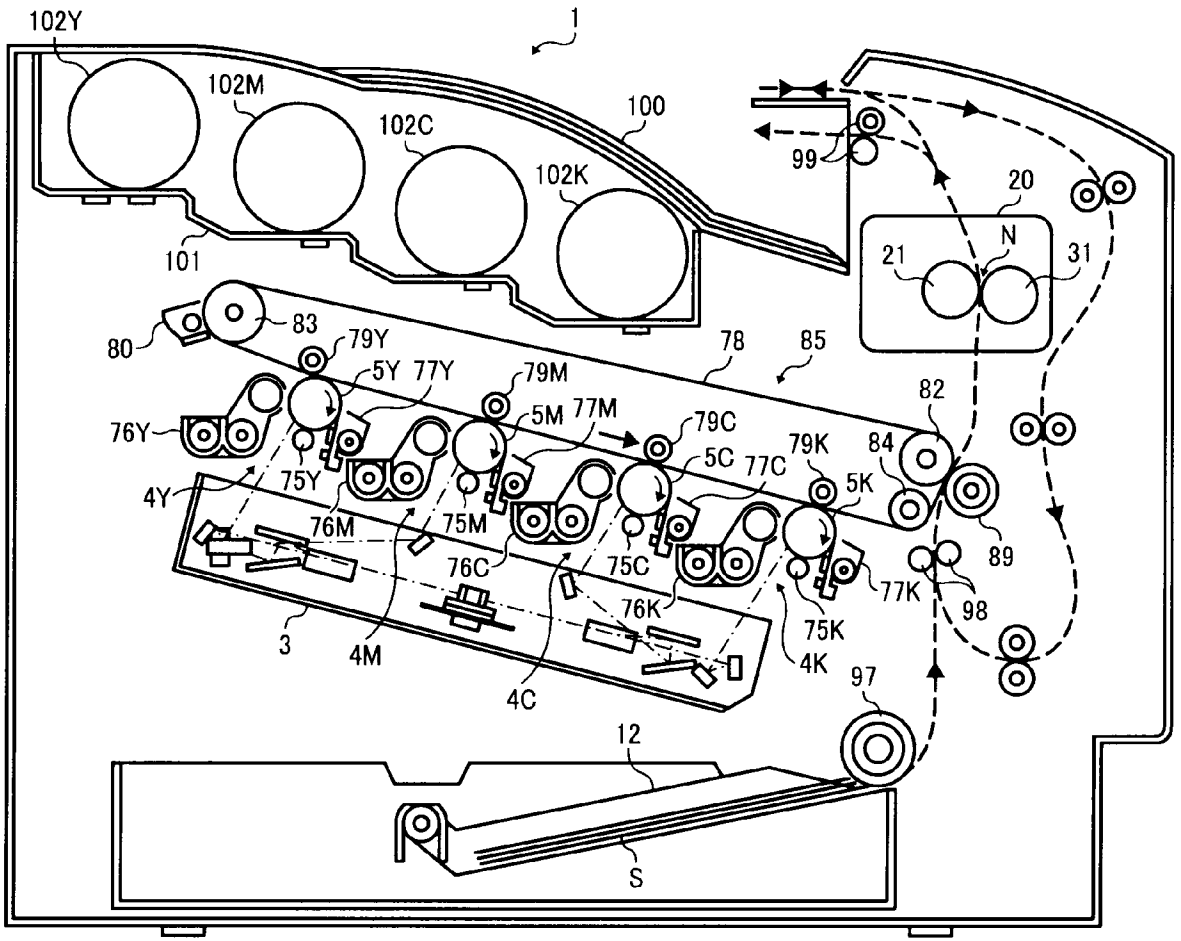
FIG. 1 schematically illustrates an image forming apparatus incorporating a fixing device according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to one embodiment of this patent specification.

As shown in FIG. 1, the image forming apparatus 1 is a tandem color printer including four imaging stations 4Y, 4M, 4C, and 4K arranged in series along the length of an intermediate transfer unit 85 and adjacent to a write scanner 3, which together form an electrophotographic mechanism to form an image with toner particles on a recording medium such as a sheet of paper S, for subsequent processing through the fixing device 20 located above the intermediate transfer unit 85. The image forming apparatus 1 also includes a feed roller 97, a pair of registration rollers 98, a pair of ejection rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop the apparatus body.

In the image forming apparatus 1, each imaging unit (indicated collectively by the reference numeral 4) has a drum-shaped photoconductor 5 surrounded by a charging device 75, a development device 76, a cleaning device 77, a discharging device, not shown, etc., which work in cooperation to form a toner image of a particular primary color, as designated by the suffix letters, "Y" for yellow, "M" for magenta, "C" for cyan, and "K" for black. The imaging units 4Y, 4M, 4C, and 4K are supplied with toner from replaceable toner bottles 102Y, 102M, 102C, and 102K, respectively, accommodated in a toner supply 101 in the upper portion of the apparatus 1.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form an area of contact or "fixing nip" N therebetween in the sheet conveyance path.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 75 and subsequently exposed to a modulated laser beam emitted from the write scanner 3. The laser exposure selectively dissipates the charge on the photoconductive surface to form an electrostatic latent image thereon according to image data representing a particular primary color. Then, the latent image enters the development device which renders the incoming image into visible form using toner. The toner image thus obtained is forwarded to the primary transfer nip between the intermediate transfer belt 85 and the primary transfer roller 79.

At the primary transfer nip, the primary transfer roller 79 applies a bias voltage of a polarity opposite that of toner to the intermediate transfer belt 85. This electrostatically transfers the toner image from the photoconductive surface to an outer surface of the belt 85, with a certain small amount of residual toner particles left on the photoconductive surface. Such transfer process occurs sequentially at the four transfer nips along the belt travel path, so that toner images of different colors are superimposed one atop another to form a multicolor image on the surface of the intermediate transfer belt 85.

After primary transfer, the photoconductive surface enters the cleaning device 77 to remove residual toner by scraping off with a cleaning blade, and then to the discharging device to remove residual charges for completion of one imaging cycle. At the same time, the intermediate transfer belt 85 forwards the multicolor image to the secondary transfer nip between the transfer backup roller 82 and the secondary transfer roller 89.

In the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 85 to the secondary transfer nip. At the secondary transfer nip, the multicolor image is transferred from the belt 85 to the recording sheet S, with a certain small amount of residual toner particles left on the belt surface.

After secondary transfer, the intermediate transfer belt 85 enters the belt cleaner 80, which removes and collects residual toner from the intermediate transfer belt 85. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the output rollers 99 to the output tray 100 for stacking outside the apparatus body, which completes one operational cycle of the image forming apparatus 1.

Figure 2:
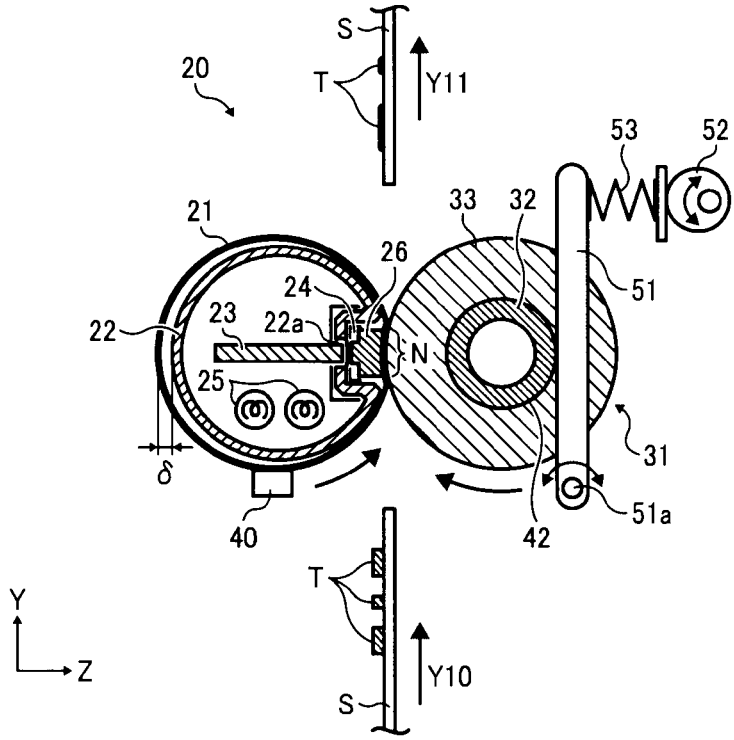
FIG. 2 is an end-on, axial cutaway view schematically illustrating the fixing device incorporated in the image forming apparatus of FIG. 1.
Figure 3:
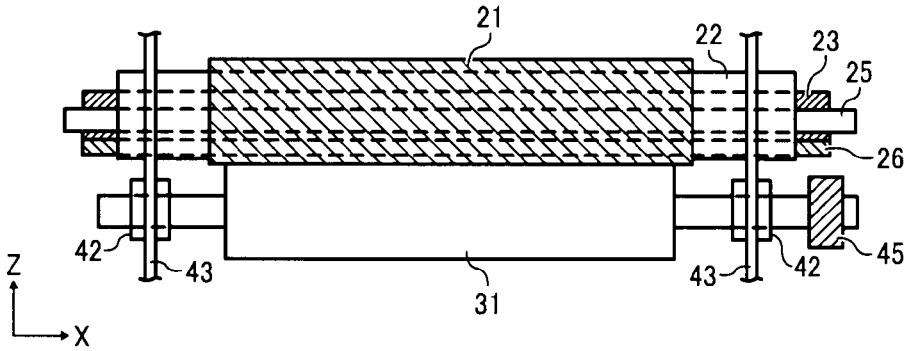
FIG. 3 is a transverse view schematically illustrating the fixing device of FIG. 2.

FIGS. 2 and 3 are end-on, axial cutaway and transverse views, respectively, schematically illustrating the fixing device 20 incorporated in the image forming apparatus 1 according to this patent specification.

As shown in FIGS. 2 and 3, the fixing device 20 includes an endless, flexible fuser belt 21 looped into a generally cylindrical configuration and a pressure roller 31 being a motor-driven rotatable cylinder, which are juxtaposed in parallel between a pair of sidewalls 43, with their longitudinal, rotational axes aligned in an axial direction X, their top and bottom sides oriented in a vertical transaxial direction Y, and their front and rear sides oriented in a horizontal transaxial direction Z perpendicular to the axial direction X.

In the fixing device 20, the looped fuser belt 21 is rotatably held around a hollow, generally cylindrical heat roll 22 internally heated with one or more heaters 25 and equipped with a fuser pad 26 combined with a reinforcing member 23, which together form a fuser assembly incorporating a roll-retaining structure to prevent deformation of the heat roll 22 according to this patent specification, a detailed description of which will be given with reference to FIG. 4 and subsequent drawings. The heat roll 22, the reinforcing member 23, and the fuser pad 26 remain substantially stationary as they hold the rotatable belt 21 in position relative to the pressure roller 31 during operation, while slightly displaceable, for example, for adjusting position in the transaxial direction Z when desired.

The pressure roller 31 is rotatably held on the sidewalls 43 via a pair of bearings 42 displaceable in the transaxial direction Z, and has one end connected to a drive motor, not shown, via a set of one or more gears 45 outside the sidewalls 43. The pressure roller 31 is pressed against the fuser belt 21 by a positioning mechanism consisting of a pressure lever 51, a motor-driven eccentric cam 52, and a spring 53, as shown in FIG. 2, connected to the roller bearing 32 to adjust position of the roller 31 in the transaxial direction Z with respect to the fuser assembly to define a fixing nip N of a desired length along the sheet conveyance path of the image forming apparatus 1.

During operation, the fixing device 20 activates the roller drive motor and the roll heater 25 as the image forming apparatus 1 is powered up. Upon activation, the heater 25 starts heating the fuser belt 21 to a processing temperature by conduction through the heat roll 22, while the pressure roller 31 starts rotation clockwise in FIG. 2 in frictional contact with the fuser belt 21, which in turn rotates around the heat roll 22 counterclockwise in FIG. 2.

Then, a recording sheet S with an unfixed, powder toner image T enters the fixing device 20 with its printed side brought into contact with the fuser belt 21 and the other side with the pressure roller 31. Upon reaching the fixing nip N, the recording sheet S moves along the rotating surfaces of the belt 21 and the roller 31 in the direction of arrow Y10, substantially flat and erect along surfaces of guide plates, not shown, disposed along the sheet conveyance path.

At the fixing nip N, the fuser belt 21 heats the incoming sheet S to fuse and melt the toner particles T, while the pressure roller 31 presses the sheet S against the fuser pad 26 held stationary by the reinforcing member 23 to cause the molten toner T to settle onto the sheet surface. As the toner image T is thus fixed in place through the fixing nip N, the recording sheet S is forwarded to exit the fixing device 20 in the direction of arrow Y11.

In the present embodiment of the fixing device 20, the heat roll 22 comprises a generally cylindrical, open-sided thin-walled hollow member with a substantially C-shaped cross-section, which has two longitudinal edges turned inward toward an interior hollow and spaced apart from each other to form an elongated longitudinal slot or cavity 24 open to the hollow interior through an opening or gap 22*a* defined between the inwardly turned longitudinal edges. It is to be noted that although the present embodiment depicts the heat roll 22 as a cylindrical member, the generally cylindrical heat roll 22 may be formed in various configurations, including cylinders, prisms, and composite shapes, and the term "substantially C-shape" refers to any circular or quasi-circular shape resembling the letter "C" defined by straight lines, curves, or a combination of both.

The heat roll 22 is mounted with its longitudinal axis aligned along the axial direction X and its open concave side directed to the pressure roller 31, and is secured in position by fastening a pair of longitudinal ends to the sidewalls 43 of the fixing device 20, while holding the fuser belt 22 around its outer circumference and accommodating the fuser pad 26 within the exterior cavity 24 and the reinforcing member 23 and the heaters 25 within the interior hollow.

Specifically, the heat roll 22 may be formed of a thin wall of thermally conductive material, such as aluminum, iron, stainless steel, or other suitable metal, approximately 0.1 to 0.2 mm in thickness. Forming the heat roll 22 with a wall thickness not exceeding 0.2 mm is desirable for promptly heating the roll circumference to a processing temperature during operation, which leads to reduced warm-up time and high thermal efficiency of the fixing device 20. In the present embodiment, the heat roll 22 is a 0.1 mm-thick walled metal roll, which may be readily obtained by bending a sheet of metal into a roll configuration through suitable metal working processes.

The roll heater 25 comprises an elongated, radiation heating element, such as a halogen heater or carbon heater. The heater 25 is inserted into the interior hollow of the heat roll 22, and is secured in position by fastening a pair of longitudinal ends to the sidewalls 43 of the fixing device 20.

The fuser belt 21 comprises a thin, multi-layered, looped flexible belt approximately 1 mm or less in thickness and approximately 15 to 200 mm in diameter (about 30 mm in the present case), the overall length of which is formed of a substrate covered with an intermediate elastic layer and an outer release coating deposited thereon, one atop another. The fuser belt 21 is held around the heat roll 21.

Specifically, the belt substrate may be a layer of metal or resin, such as nickel, stainless steel, polyimide, or the like, approximately 30 to 50 μm in thickness. The intermediate elastic layer may be a deposit of rubber, such as solid or foamed silicone rubber, fluorine resin, or the like, approximately 100 to 300 μm in thickness. The outer coating may be a deposit of release agent, such as tetra fluoro ethylene-perfluoro alkylvinyl ether copolymer or Perfluoroalkoxy (PFA), polytetrafluoroethylene (PTFE), polyimide (PI), polyetherimide (PEI), polyethersulfone (PES), or the like, approximately 10 to 50 μm in thickness.

The intermediate elastic layer serves to accommodate minute variations in applied pressure to maintain smoothness of the belt surface at the fixing nip N, which ensures uniform distribution of heat across a recording sheet S to yield a resulting image with a smooth, consistent appearance. Further, the release coating layer provides good stripping of toner from the belt surface to ensure reliable conveyance of recording sheets S through the fixing nip N.

To warm up the fixing device 20, the heater 25 heats the heat roll 22 directly by radiation from inside, and the fuser belt 21 indirectly by conduction through the heat roll 22. That is, the heater 25 irradiates the inner circumference of the heat roll 22, which then conducts the irradiated heat to those portions of the fuser belt 21 in contact with the roll circumference (i.e., outside the fixing nip N). As the fuser belt 21 rotates, this results in uniformly heating the entire length of the rotating belt 21 sufficiently for fusing toner at the fusing nip N. Such heating is controlled by a controller that regulates power supply according to readings of a thermometer or thermistor 40 sensing temperature of the outer circumference of the fuser belt 21 to maintain a desired processing temperature.

In such a configuration, the fuser belt 21 has its length heated substantially continuously and uniformly by conduction from the outer circumference of the heat roll 22 internally irradiated by the heater 25. Compared to directly and locally heating portions of a fuser member, such indirect continuous heating can warm up the entire length of the fuser belt 21 swiftly and efficiently with a relatively simple configuration, which allows the fixing device 20 to operate at higher processing speeds without causing image defects due to premature entry of recording sheets into the fixing nip N. This leads to a reduction in warm-up time and first print time required for completing an initial print job upon startup, while maintaining a small size of the image forming apparatus 1 incorporating the fixing device 20.

Preferably, the inner circumference of the fuser belt 21 and the outer circumference of the heat roll 22 has a gap δ greater than 0 mm and not exceeding 1 mm except at the fixing nip N where the heat roll circumference forms the side cavity 24. Maintaining a non-zero gap δ between the fuser belt 21 and the heat roll 22 prevents the elastic belt surface from premature wear caused by excessively rubbing against the metal roll surface. Moreover, holding the belt-to-roll gap δ within an adequate range ensures efficient heat transfer from the heat roll 22 to the fuser belt 21, which prevents failures caused by insufficient heating at the fixing nip N, and also maintains the flexible belt 21 in a generally cylindrical configuration around the heat roll 22 for preventing deformation and concomitant deterioration and breakage of the belt 21.

More preferably, the fuser belt 21 and the heat roll 22 are provided with a lubricant, such as fluorine grease, deposited between their adjoining surfaces. Such lubrication reduces friction at the interface, and thus prevents wear and tear on the fuser belt 21 even when operated in continuous frictional contact with the heat roll 22. Similar effects may be obtained by coating the outer surface of the heat roll 22 with a material of a relatively low frictional coefficient, or forming the fuser belt 22 with an innermost layer of lubricant such as fluorine-based material.

With continued reference to FIGS. 2 and 3, the fuser pad 26 comprises an elongated member of a length similar to that of the heat roll 22, with a front, elastic side and a rear, rigid side, a detailed description of which will be given with reference to FIG. 4 and subsequent drawings.

The fuser pad 26 is mounted within the side cavity 24 of the heat roll 22, with its longitudinal axis aligned with the axial direction X, its front side directed toward the pressure roller 31, and its rear side directed toward the roll opening 22*a*, and is secured in position by fastening a pair of longitudinal ends to the sidewalls 43 via a flange and coupling, not shown. The fuser pad 26 remains substantially stationary in the axial direction X and slightly displaceable in the transaxial directions Y and Z, with clearance left between adjoining surfaces of the fuser pad 26 and the roll cavity 24.

The reinforcing member 23 comprises a rigid elongated piece of a length similar to that of the fuser pad 26, a detailed description of which will be given with reference to FIG. 4 and subsequent drawings.

The reinforcing member 23 is mounted within the interior hollow of the heat roll 22, with its longitudinal axis aligned with the axial direction X and its front side held against the fuser pad 26 through the side opening 22*a*, and is secured in position by fastening a pair of longitudinal ends to the sidewalls 43.

In such a configuration, the fuser pad 26 has its front side in pressure frictional contact with the inner surface of the fuser belt 21 at the fixing nip N where the pressure roller 31 is pressed against the fuser belt 21. Note that, with the fuser pad 26 disposed in the roll cavity 24 to support pressure from the pressure roller 31, the concave-sided heat roll 22 remains substantially isolated from pressure from the pressure roller 31 at the fixing nip N. This prevents the heat roll 22 from bending or bowing under nip pressure, which would be the case with a configuration where a purely cylindrical heat roll contacts a pressure member through a fuser belt.

The reinforcing member 23 serves to strengthen and support the fuser pad 26 in position subjected to pressure from the pressure roller 31 in the fixing nip N. That is, the reinforcing member 23 thrusts against the fuser pad 26 through the roll opening 22*a*, so that the fuser pad 26 does not displace or deform in the transaxial direction Z under pressure applied by the pressure roller 31.

Preferably, the reinforcing member 23 is formed of metal, such as stainless steel or iron, which exhibits sufficient stiffness required to support the fuser pad 26 in position and shape. Further, the reinforcing member 23 may have its rear side (i.e., the side that faces the heater 25 upon installation in the interior hollow of the heat roll 22) partially or entirely coated with a thermal insulation coating, or subjected to a bright annealing or mirror polish during manufacture. Such surface treatment causes the reinforcing member 23 to repel or reflect radiation from the heater 25, which allows the heat roll 22 to efficiently absorb heat generated by the heater 25 for transfer to the fuser belt 21, leading to enhanced heating efficiency in the fixing device 20.

With further reference to FIGS. 2 and 3, the pressure roller 31 comprises a cylindrical rotatable body approximately 30 mm in diameter, formed of a hollow, cylindrical metal core 32 covered with an outer layer 33 of elastic material, such as foamed or solid silicone rubber, fluorine rubber, or the like, and optionally, with an additional coating of release agent, such as PFA, PTFE, or the like, deposited on the elastic layer 33. Further, the pressure roller 31 may have a heating element, such as a halogen heater, within the interior of the hollow roller core 32.

Forming the roller outer layer 33 with sponge material is advantageous, since it prevents excessive nip pressure, which would otherwise cause the fuser pad 26 to substantially bend away from the pressure roller 31 at the fixing nip N. Another advantage is that it provides favorable thermal insulation at the fixing nip N to prevent heat transfer from the fuser belt 32 to the pressure roller 31, leading to enhanced heating efficiency in the fixing device 20.

Although the fuser belt 21 and the pressure roller 31 are of a substantially identical diameter in the embodiment depicted in FIGS. 2 and 3, instead, it is possible to provide the cylindrical fixing members 21 and 31 with different diameters, in particular, the fuser belt 21 with a relatively small diameter and the pressure roller 31 with a relatively large diameter. Forming the fuser belt 21 with a diameter smaller than that of the pressure roller 31 translates into a greater curvature of the fuser belt 21 than that of the pressure roller 31 at the fixing nip N, which effects good stripping of a recording sheet from the fuser belt 21 upon exiting the fixing nip N. In any configuration, the concave side of the heat roll 22 is dimensioned so that pressure exerted by the pressure roller 31 does not act on the heat roll 22 regardless of the relative diameters of the fuser belt 21 and the pressure roller 31.

As mentioned, the pressure roller 31 is equipped with the positioning mechanism formed of the pressure lever 51, the eccentric cam 52, and the spring 53. The pressure lever 51 has one hinged end provided with a hinge 51*a* and another, free end loaded with the spring 53 connected to the eccentric cam 52 via a spacer, while supporting the rotational axis of the pressure roller 31 via the roller bearing 42 displaceably held on the sidewall 43. The eccentric cam 52 is driven for rotation by a motor, not shown, to cause the pressure lever 51 to swivel on the hinge 51*a*, which in turn displaces the pressure roller 31 either toward or away from the fuser belt 21 in the horizontal transaxial direction Z.

Such positioning mechanism enables the fixing device 20 to move the pressure roller 31 into pressure contact with the fuser belt 21 to form a desired fixing nip by setting the eccentric cam 52 to an operating position (i.e., such as one depicted in FIG. 2) upon entering operation, and to retract the pressure roller 31 away from the fuser belt 21 to remove nip pressure by rotating the eccentric cam 52 by 180 degrees from the operating position when out of operation or under maintenance.

Figure 4:
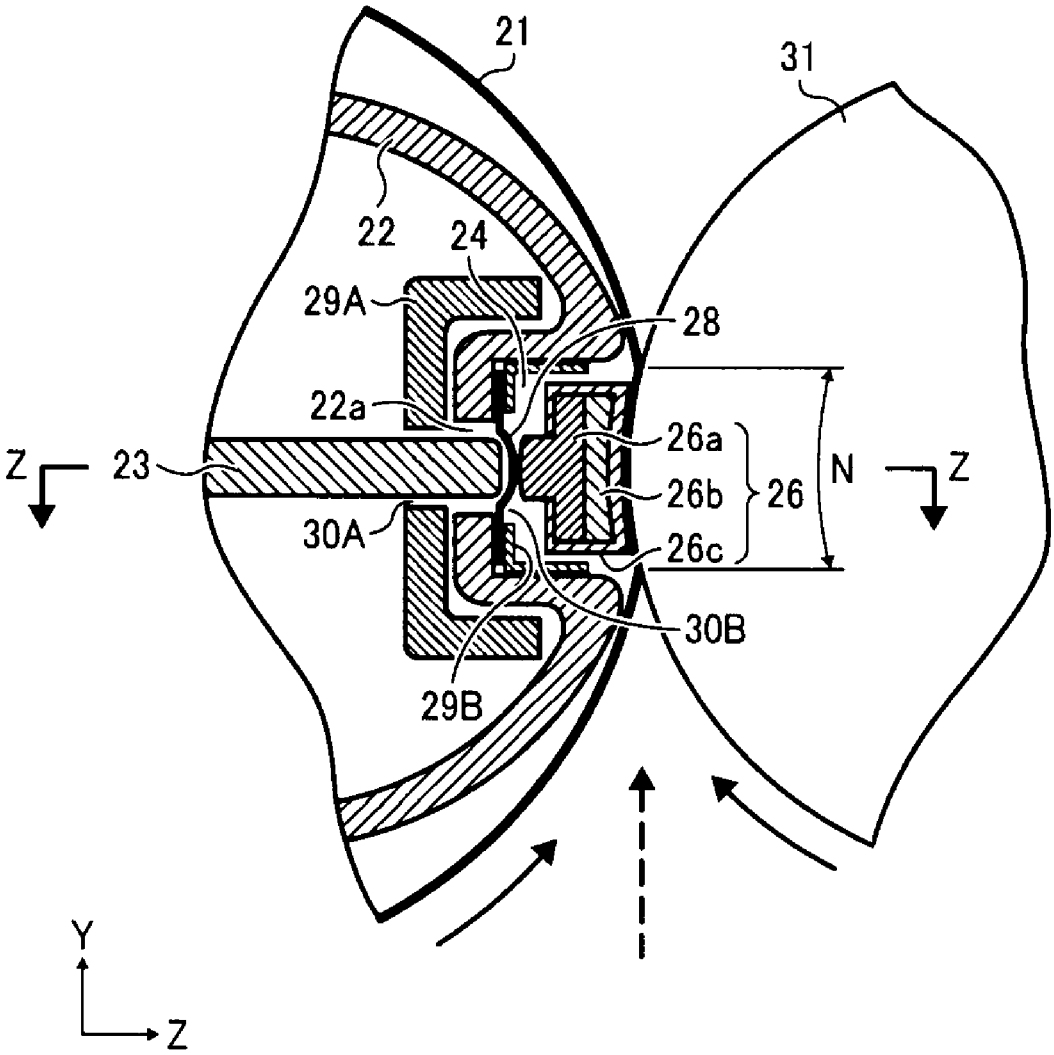
FIG. 4 is an enlarged, end-on, axial cutaway view illustrating in detail the fuser assembly for use in the fixing device 20 of FIG. 2.

FIG. 4 is an enlarged, end-on, axial cutaway view illustrating in detail the fuser assembly included in the fixing device 20 of FIG. 2.

As shown in FIG. 4, the heat roll 22 has its open concave side provided with a pair of first and second shape retaining stays 29A and 29B, one disposed interior and the other exterior of the roll opening 22*a*, which retain the generally cylindrical shape of the heat roll 22 by clamping together the inwardly turned edges of the roll 22 from inside and outside the roll hollow. Between the walls of the second stay 29B and the heat roll 22 is a sealing sheet 28, which seals the opening 22*a* from outside the roll hollow.

Figure 5A:
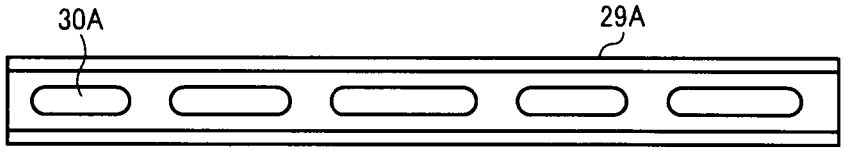
FIG. 5A through 5C are front side views schematically illustrating a first retaining stay, a second retaining stay, and a sealing sheet, respectively, used in the fuser assembly of FIG. 4.
Figure 5B:
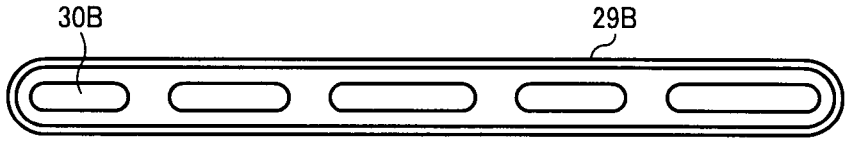
Figure 5C:
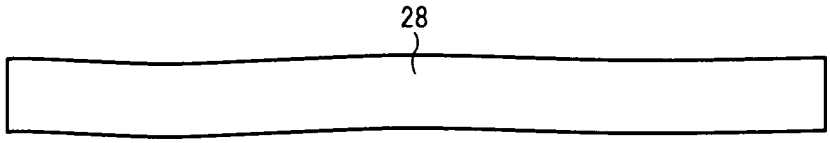

FIGS. 5A through 5C are front side views schematically illustrating the first stay 29A, the second stay 29B, and the sealing sheet 28, respectively, used in the fuser assembly of FIG. 4.

As shown in FIG. 5A, the first stay 29A is an open-ended trough-like piece of rigid material with a rectangular U-shaped cross-section configured to closely follow the bent walls of the heat roll 22 from inside, consisting of a center wall perforated with one or more oval through-holes 30A and a pair of parallel sidewalls extending from opposing sides of the center wall. For example, the first stay 29A may be formed by processing a stainless steel plate approximately 1.5 mm thick into a trough-like configuration. The first stay 29A may have its rear side (i.e., the side that faces the heater 25 in the roll hollow) at least partially treated through a bright annealing or mirror polish process to increase heating efficiency of the fixing device 20, as in the case with the reinforcing member 23.

Referring to FIG. 5B, the second stay 29B is a box-like piece of rigid material with a rectangular U-shaped cross-section configured to closely follow the bent walls of the heat roll 22 from outside, consisting of a center wall perforated with one or more oval through-holes 30B and a pair of generally parallel sidewalls extending from opposing sides of the center panel and connecting to each other at both ends thereof. For example, the second stay 29B may be formed by processing a stainless steel plate approximately 0.5 mm thick into a box-like configuration.

Referring further to FIG. 5C, the sealing sheet 28 is a deformable thin film of a dimension similar to those of the first and second stays 29A and 29B. For example, the sealing sheet 28 may be a film of suitable elastic material (silicone rubber in the present embodiment), formed into a thin layer with a thickness approximately 1 mm or less, preferably, between approximately 0.1 mm to approximately 0.5 mm. Materials suitable for the sealing sheet 28 include silicone rubber, fluorine rubber, and fluororesin, which exhibit certain properties desirable as a sealant, such as a high degree of protection against oil leakage, relatively small change in thickness under compression, relatively high modulus of elongation (which allows for both lower and higher degrees of elongation when stretched), and a relatively high degree of heat resistance.

With continued reference to FIG. 4, in use, the first stay 29A is fitted on the inner wall of the heat roll 22 over the side cavity 24 with the through-holes 30A aligned with the roll opening 22*a*. Similarly, the second stay 29B is press-fitted on the outer wall of the heat roll 22 within the side cavity 24 with the through-holes 30B aligned with the roll opening 22*a*. The sealing sheet 28 is disposed over the roll opening 22*a* with its edges pinched between the walls of the heat roll 22 and the second stay 29B, and its center portion slightly deforming away from the opening 22*a* as the reinforcing member 23 thrusts into the roll cavity 24 against the fuser pad 26 through the opening 22*a*.

In such a configuration, the first and second retaining stays 29A and 29B serve to prevent the heat roll 22 from deforming due to elastic recovery of the roll material after bending, known in the art as "springback". That is, the retaining stays 29A and 29B clamping together the inwardly turned edges of the roll wall prevent the gap between the inwardly turned edges from widening, thereby preventing the open-sided roll 22 from losing its generally cylindrical shape. If not corrected, deformation of a heat roll can cause various defects due to interference or mis-coordination between the fuser belt and the heat roll, such as the belt getting damaged or making noise by excessively rubbing against the fuser roll, or running out of track by slipping off the roll surface.

Specifically, providing the first stay 29A to retain the opening edges from inside the roll hollow effectively prevents roll springback and allows for precisely forming the concavity 24 in a desired configuration. Further, providing the second stay 29B to retain the opening edges from outside the roll hollow not only prevents roll springback, but also enables the sealing sheet 28 to tightly seal the opening 22*a* by closely fitting the roll walls around the opening 22*a* from outside, which may be ensured by providing a heat-resistant sealing material where the stay 29B press-fits the roll cavity walls.

In addition, the sealing sheet 28 serves to prevent entry of foreign matter into the interior hollow of the heat roll 22 through the opening 22*a*, in particular, that of lubricant provided between the heat roll 22 and the fuser belt 21. Leaking lubricant from outside to inside the heat roll not only results in loss of lubrication, which causes high friction between the roll and belt surfaces to promote wear and tear, but also results in malfunctioning of or damage to the roll heater where lubricant adheres to the roll heater and evaporates in the roll hollow. Thus, providing the sealing sheet 28 is desirable particularly where the heat roll 22 and the fuser belt 21 are provided with a lubricant with high penetration rates, such as fluorine grease, which is the case for the present embodiment.

Moreover, the sealing sheet 28, which is formed of elastic material and hence allows for deformation, can absorb tensile force resulting from pressure between the reinforcing member 23 and the fuser pad 26 and/or displacement of the interface between the reinforcing member 23 and the fuser pad 26, where the pressure roller 31 presses against the fuser belt 21 at variable nip pressure. Thus, although the interface between the reinforcing member 23 and the fuser pad 26 is connected to the heat roll 22 through the sealing sheet 28, the heat roll 22 remains substantially isolated from tensile stress. This prevents the heat roll 22 from deformation, even where the heat roll 22 is of an extremely thin sheet of material, or where the pressure roller 31 presses against the fuser belt 21 at a high nip pressure, or where the pressure roller 31 is displaced toward and away from the fuser belt 21 to vary the nip pressure.

Preferably, such sealing sheet 28 is provided outside the pipe hollow rather than inside, as in the embodiment depicted in FIG. 4. This is because disposing the sealing sheet in the heated interior of the heat roll could cause thermal degradation of elastic material promoted by radiation from the heater 25 inside the heat roll 22.

In addition, although the sealing sheet 28 varies in thickness by stretching and deforming upon installation and operation, such thickness variation is negligible and does not affect pressure between the reinforcing member 23 and the fuser pad 26.

Figure 6:
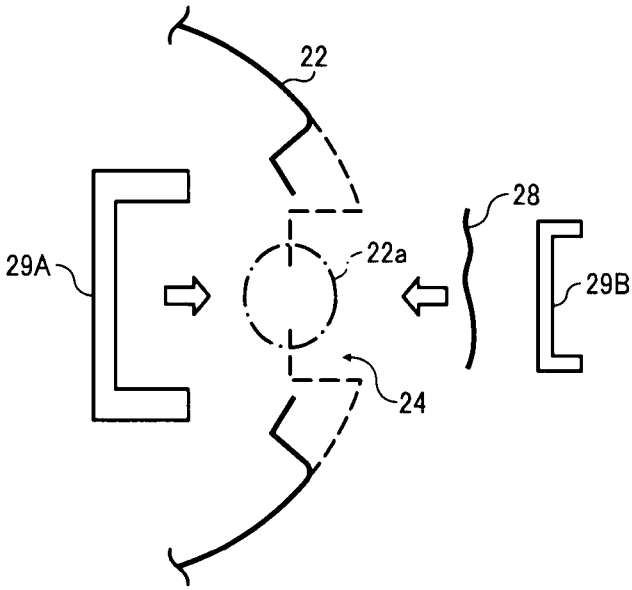
FIG. 6 schematically illustrates a heat roll used in the fuser assembly of FIG. 4 with the first and second stays and the sealing sheet being assembled.

FIG. 6 schematically illustrates the heat roll 33 with the first and second stays 29A and 29B and the sealing sheet 28 during assembly.

As shown in FIG. 6, the heat roll 22 is prepared by bending a thin sheet of thermally conductive material (e.g., a stainless steel sheet approximately 0.1 mm thick, which is available for ready processing) into a rolled configuration, with two opposing edges turned inward and bent toward each other to define a letter "L" in cross-section while spaced away from each other to form the side cavity 24 open to the roll hollow through the opening 22*a*.

Once the open concave-sided roll 22 is obtained, the first stay 29A is inserted into the hollow interior of the roll 22 and fit over the roll cavity 24 from inside the roll hollow, so as to retain the rolled configuration of the heat roll 22. Then, the sealing sheet 28 is deposited over the opening 22*a* from outside the roll hollow, followed by press fitting the second stay 29B into the roll cavity 24 from outside the roll hollow to complete the roll assembly.

Thus, with the retaining stays 29A and 29B clamping together the opposing edges of the rolled sheet, the heat roll 22 is assembled into a desired shape with the cavity 24 and the opening 22*a* formed on its open-concave side (as indicated by broken lines), which is maintained without deterioration upon installation and operation in the fixing device 20.

Referring back to FIG. 4, the fuser pad 26 is formed of a stiff portion 26*a* and an elastic portion 26*b* combined together into an integrated structure, which is integrally covered with a lubricant sheet 26*c*. The fuser pad 26 is installed without steady coupling to the heat roll 22 while surrounded by the box-shaped second stay 29B, which substantially prevents the fuser pad 26 from substantial displacement in the transaxial directions Y and Z.

In the fuser pad 26, the stiff portion 26*a* is formed of sufficiently stiff material, such as rigid metal or ceramic, to endure pressure from the pressure roller 31, with a rigid flange projecting from its exposed side to contact the reinforcing member 23. The elastic portion 26*b* is formed of rubber with its exposed side defining a pliant contact surface to establish sliding contact with the pressure roller 31 through the fuser belt 21. The lubricant sheet 26*c* is impregnated with lubricant such as fluorine grease, which reduces frictional resistance between the fuser pad 26 and the fuser belt 21.

The pliant elastic portion 26*b* closely conforms to minute irregularities in the surface of a toner image processed through the fixing nip N for obtaining good fusing performance, with its contact surface available in various configurations according to particular applications of the fixing device 20.

For example, the contact surface of the elastic portion 26*b* may be slightly concave with a curvature similar to that of the circumference of the pressure roller 31. The concave contact surface readily conforms to the surface of the pressure roller 31 along which a recording sheet S passes through the fixing nip N, which ensures reliable conveyance of the sheet S without adhering to and wrapping around the fuser belt 21 upon exiting the fixing nip N.

Alternatively, instead of the concave configuration, the contact surface of the elastic portion 26*b* may be substantially flat. The flat contact surface causes a recording sheet S to remain straight and uniformly contact the fuser belt 21 within the fixing nip N, resulting in efficient fusing performance, while allowing for good stripping of the recording sheet S from the fuser belt 21 which exhibits a curvature larger at the exit of the fixing nip N than within the fixing nip N.

The rigid portion 26*a* of the fuser pad 26 accommodates variations in contact pressure occurring along the axial direction X even where the reinforcing member 23 and the fuser pad 26 contact each other partially along their longitudinal edges, so as to ensure uniform distribution of pressure along the length of the fuser pad 26 within the fixing nip N. Such arrangement is particularly desirable where reinforcing member 23 has its front side designed with a non-planar configuration, as described below with reference to FIGS. 7A and 7B.

Figure 7A:
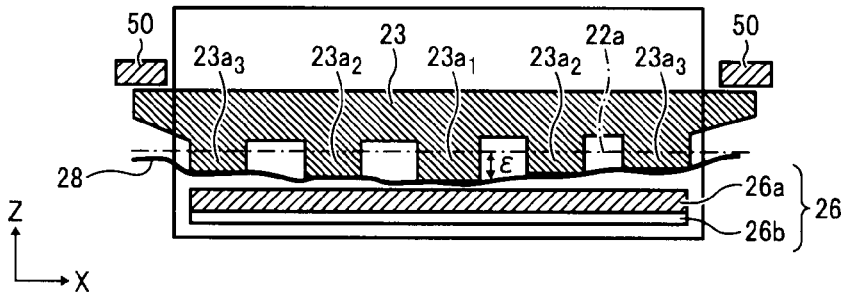
FIGS. 7A, 7B, and 7C schematically illustrate a reinforcing member used with a fuser pad in the fuser assembly under no-load condition, under load condition, and with various types of recording sheets under load condition, respectively, shown in cross-sectional views taken along a line Z-Z of FIG. 4.
Figure 7B:
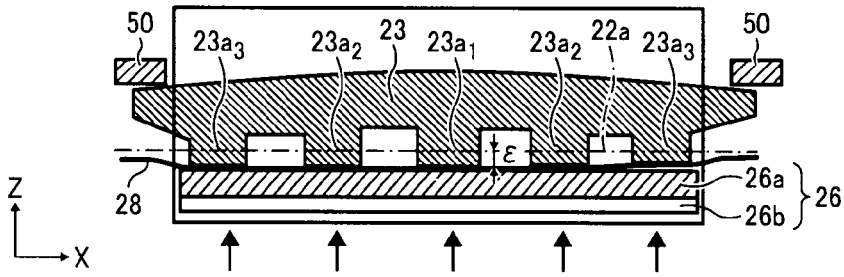

FIGS. 7A and 7B schematically illustrate the reinforcing member 23 used with the fuser pad 26 under no-load and load conditions, respectively, shown in cross-sectional views taken along a line Z-Z of FIG. 4.

As shown in FIGS. 7A and 7B, the reinforcing member 23 comprises an elongated plate of rigid material, such as stainless steel, with two ends anchoring to a pair of anchors 50 provided on the sidewalls 43 and a set of multiple flanges $\mathbf{23}a_1$ through $\mathbf{23}a_3$ provided along the front side directed toward the fuser pad 26, each flange 23*a* passing through the first stay through-hole 30A, the roll opening 22*a*, and the second stay through-hole 30B to reach the roll cavity 24 where it contacts the rigid portion 26*a* of the fuser pad 26 via the sealing sheet 28 being deformed. The flanges 23*a* have a cross-section smaller than those of the through-holes 30A and 30B for ready insertion into the through-holes 30A and 30B without interfering with the adjoining surfaces of the first and second stays 29A and 29B.

Specifically, the multiple flanges $\mathbf{23}a_1$ through $\mathbf{23}a_3$ of the reinforcing member 23 have different lengths along the transaxial direction Z and are symmetrically disposed along the axial direction X, the longest one $\mathbf{23}a_1$ at the center, the shortest ones $\mathbf{23}a_3$ at the ends, and the intermediate ones $\mathbf{23}a_2$ between the center and each end, to together form a crowned shape of the reinforcing member 23 thickest in the center and thinnest at each end along the axial direction X.

More specifically, under no-load condition where there is substantially no pressure at the fixing nip N as shown in FIG. 7A, the reinforcing member 23 is in its original, crowned configuration, with the longest, central flange $\mathbf{23}a_1$ extending beyond the opening 22*a* edge into the cavity 24 by an amount greater than those of the other flanges $\mathbf{23}a_2$ and $\mathbf{23}a_3$, so that the flanged side of the reinforcing member 23 forms a convex surface to establish contact with the fuser pad 26 closer to the fuser pad 26 at the center than at the ends along the axial direction X.

Once a certain nip pressure is applied to enter load condition, the crowned reinforcing member 23, having two ends fastened to the anchors 50, bends away from the fuser pad 26 as shown in FIG. 7B. This results in the central flange $\mathbf{23}a_1$ retracting from the cavity 24 by an amount greater than those of the other flanges $\mathbf{23}a_2$ and $\mathbf{23}a_3$, so that the flanged side of the reinforcing member 23 forms a substantially flat surface to establish consistent close contact with the fuser pad 26 along the axial direction X.

Such arrangement allows for uniform distribution of pressure across the fixing nip N and uniform length of contact between the pressure roller 31 and the fuser belt 21 even where the reinforcing member 23 bends away from the fuser pad 26 under applied nip pressure. That is, in a configuration where a reinforcing member has a flat, planar surface to contact a fuser pad, bending the reinforcing member results in the fuser pad pressing against the pressure roller more closely at the longitudinal ends than at the longitudinal center, which means variations in pressure and length of the fixing nip, eventually causing improper rotation of the fuser belt and concomitant failure of sheet conveyance through the fixing nip. Crowning the reinforcing member 23 effectively compensates for bending of the reinforcing member to prevent variations in the fixing nip N, thereby ensuring proper sheet conveyance and belt rotation through the fixing nip N.

Preferably, the flanges 23*a* define multiple planar facets on their respective surfaces to approximate a convex surface when the reinforcing member 23 is in the original shape under no-load condition.

Figure 8A:
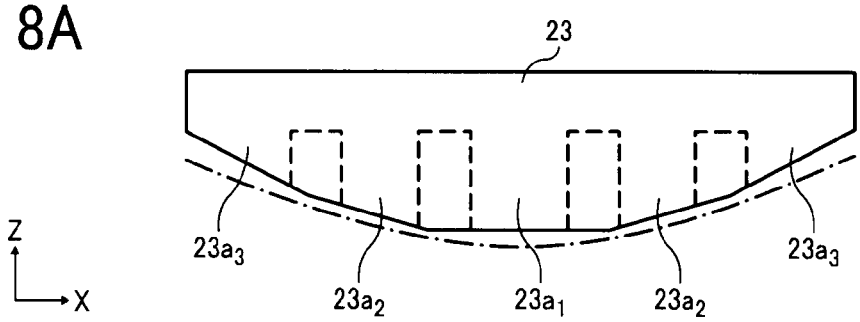
FIGS. 8A and 8B schematically illustrate the reinforcing member with different configurations of multiple flanges.
Figure 8B:
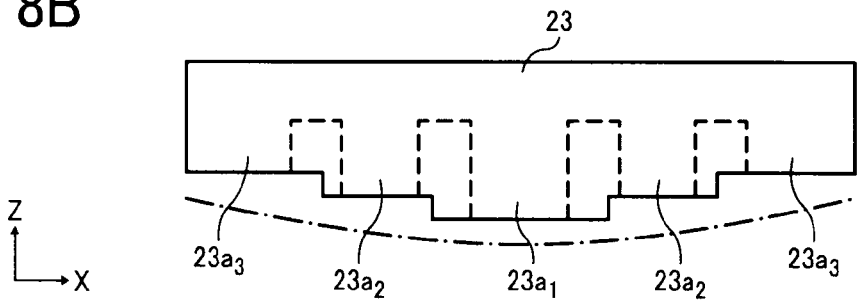

For example, as shown in FIG. 8A, the flanges 23*a* may form multiple planar facets angled with respect to each other, so that planes defined by two neighboring facets intersect each other between the corresponding flanges 23*a*. Alternatively, as shown in FIG. 8B, the flanges 23*a* form multiple planar facets parallel to each other, so that planes defined by two neighboring facets are spaced apart from each other in the transaxial direction Z. In either configuration, the multiple facets align with each other on a substantially identical plane as the reinforcing member 23 enters load condition, leading to uniform distribution of pressure across the fixing nip N as in the embodiment depicted in FIGS. 7A and 7B.

Compared to precisely forming the flanges with a curved continuous surface, forming the flanges with planar facets allows for simple and cost-efficient production of the reinforcing member 23, in which the material of the flange is facetted and subsequently cut to remove portions where two neighboring facets form an angle or edge therebetween as shown by broken lines in FIGS. 8A and 8B. Forming the respective facets in planar configuration is desirable since any irregularity on the contact surface of the flange 23*a* can cause variation in nip pressure during operation.

With further reference to FIGS. 7A and 7B, there is shown the fuser pad 26 displaced in the transaxial direction Z toward the edge of the roll opening 22*a* as the fixing device 20 enters load condition from non-load condition. As mentioned, the fuser pad 26 is disposed within the cavity 24 of the heat roll 22 with clearance left between adjoining surfaces of the fuser pad 26 and the cavity 24. Provision of the clearance prevents the fuser pad 26 from interfering with the edges of the opening 22*a* to deform the heat roll 22, when the reinforcing member 23 bends to allow the fuser pad 26 to move toward the opening 22*a* under applied nip pressure.

Further, the sealing sheet 28, which has a limited range of elastic deformation, elongates toward the fuser pad 26 in the transaxial direction Z by a certain amount $\epsilon$ depending on position of an interface between the reinforcing member 23 and the fuser pad 26. Such elongation amount $\epsilon$ varies between highest and lowest values, as the fixing device 29 switches between no-load and load conditions to change position of the interface between the reinforcing member 23 and the fuser pad 26.

For example, consider a case in which the sealing sheet 28 has a maximum limit of elastic deformation of approximately 3 to 4 mm in the transaxial direction Z. In this case, the elongation amount $\epsilon$ may have a highest value of approximately 2 mm under no-load condition where the interface between the reinforcing member 23 and the fuser pad 26 remains farthest from the plane of the opening 22*a* (see FIG. 7A), and a lowest value of approximately 1.3 mm under load condition where the interface between the reinforcing member 23 and the fuser pad 26 moves closer to the plane of the opening 22*a* approximately 0.7 mm from the initial position (see FIG. 7B).

As mentioned, the deformable sealing sheet 28 can absorb tensile force resulting from pressure between the reinforcing member 23 and the fuser pad 26 and/or displacement of the interface between the reinforcing member 23 and the fuser pad 26, so as to substantially isolate the heat roll 22 from tensile stress and subsequent deformation. Such stress-absorbing function of the sealing sheet 28 also works even where the interface between the reinforcing member 23 and the fuser pad 26 moves by an amount substantially equivalent to the amount of crowning of the reinforcing member 23, which may be approximately 1 mm or less in the embodiment described herein.

Preferably, each flange 23 of the reinforcing member 23 has rounded edges, which prevents damage to the sealing sheet 28 upon pressing against the reinforcing member 23 under load condition.

More preferably, the reinforcing member 23 is provided with a flange positioning mechanism that enables adjusting relative positions of the multiple flanges 23*a* in the transaxial direction Z to maintain a uniform pressure distribution across the fixing nip N.

Still more preferably, the multiple flanges 23, or the first and second stay through-holes 30A and 30B determining position of the flanges 23, are disposed along the axial direction X without coinciding with the side edges of recording sheets accommodated in the conveyance path of the image forming apparatus 1 upon installation and operation.

Figure 7C:
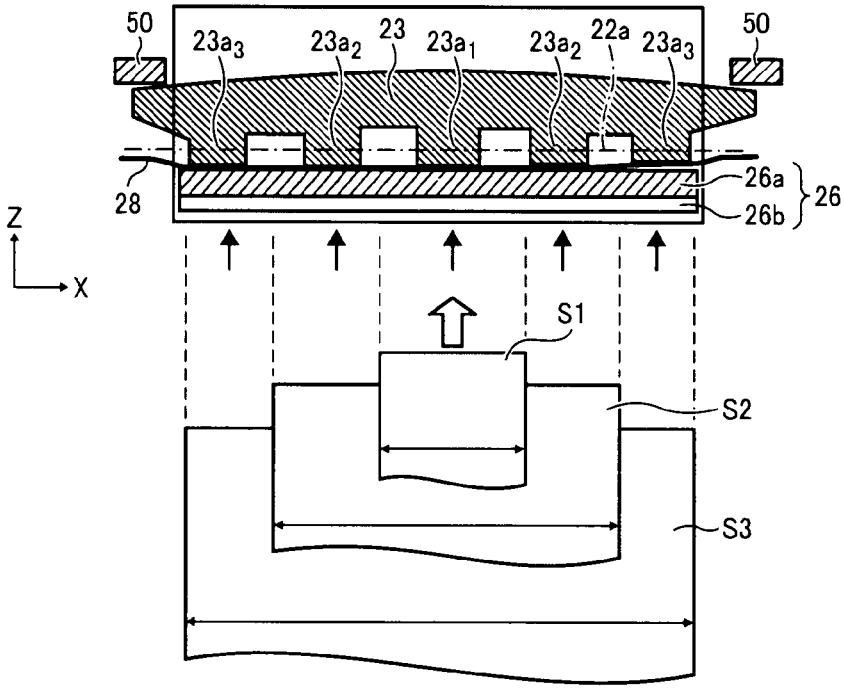

With reference to FIG. 7C, there is shown the reinforcing member 23 with three standard types of copy paper used in the image forming apparatus 1 (i.e., an A3-size paper sheet S1, an A4-size paper sheet S2, and an A5-size paper sheet S3), conveyed with their longer sides aligned along the direction of transport in the conveyance path. The multiple flanges 23*a* of the reinforcing member 23 are disposed at intervals therebetween, so that all the types of recording sheets S1 through S3 have their longitudinal edges not coinciding with any of the flanges 23 of the reinforcing member 23 positioned.

The lack of coincidence between the reinforcement flanges 23 and the sheet side edges allows the elastic portion 26*b* of the fuser pad 26 to readily deform toward the reinforcing member 23 upon contacting the side edges of a recording sheet, so as to prevent a localized high pressure along the sheet edges within the fixing nip N, which would otherwise damage the surfaces of the fuser belt 21 and the pressure roller 31.

Although the embodiment shown in FIGS. 7A and 7B depicts the reinforcing member 23 in a crowned configuration and the fuser pad 26 in a planar configuration, alternatively, it is also possible to form the fuser pad 26 in a crowned configuration and the reinforcing member 23 in a planar configuration, in which case the fuser pad 26 has its rear, flanged side closest to the reinforcing member 23 at the center and farthest from the reinforcing member 23 at each end under no-load condition.

Figure 9A:
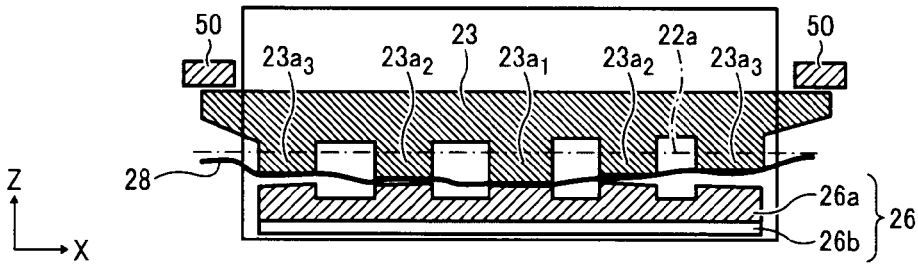
FIGS. 9A and 9B schematically illustrate another embodiment of a reinforcing member used with a fuser pad in the fuser assembly under no-load and load conditions, respectively, shown in cross-sectional views taken along line Z-Z of FIG. 4.
Figure 9B:
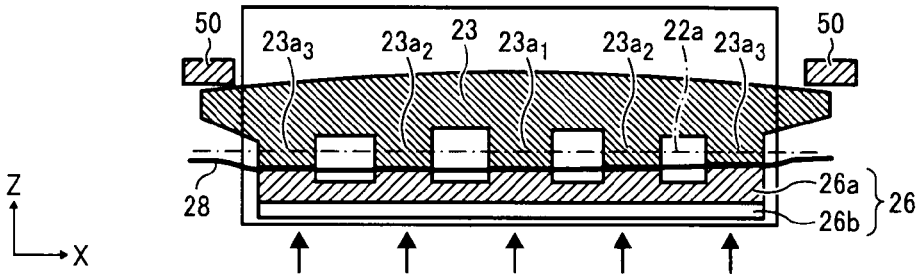

Moreover, it is also possible to form the fuser pad 26 and the reinforcing member 23 both in a crowned configuration. In this case, the fuser pad 26 and the reinforcing member 23 are both axially tapered with their flanged sides closest to each other at the center and farthest from each other at each end under no-load condition as shown in FIG. 9A, while establishing substantially uniform contact under load condition as shown in FIG. 9B.

Although in the embodiment described primarily with reference to FIG. 4 and FIGS. 5A through 5C, the sealing sheet 28 is secured to the wall of the roll cavity 24 by press fitting the second stay 29B within the roll cavity 24, fixing the sealing sheet 28 in position may also be accomplished through other suitable fastening methods.

Figure 10A:
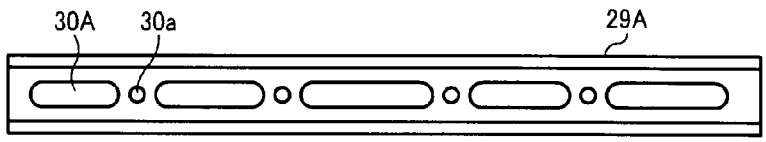
FIG. 10A through 10C are front side views schematically illustrating another embodiment of the first retaining stay, the second retaining stay, and the sealing sheet, respectively, for use in the fuser assembly of FIG. 4.
Figure 10B:
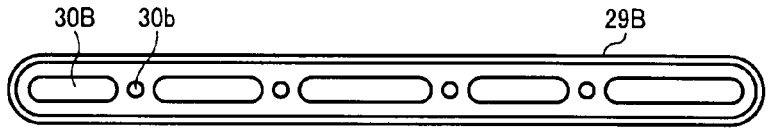
Figure 10C:
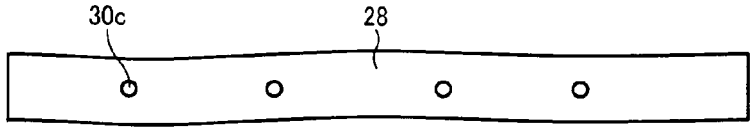

For example, as shown in FIGS. 10A through 10C, the first and second stays 29A and 29B may be perforated with multiple screw holes 30*a* and 30*b*, respectively, in addition to the through-holes, and the sealing sheet 28 with a set of multiple screw holes 30*c*. Each set of screw holes 30*a*, 30*b*, and 30*c* is disposed along the axial direction X to align with corresponding ones of the other sets of screw holes when the sealing sheet 28 is assembled with the first and second stays 29A and 29B, allowing for insertion of screws from the second stay 29B toward the first stay 29A via the sealing sheet 28 to fasten the sealing sheet 28.

In such cases, the heat roll 22 may have a set of internal screws arranged along the axial direction X for alignment with the screw holes 30*a*, 30*b*, and 30*c*, which allows for fastening the sealing sheet 28 not only to the first and second stays 29A and 29B but also to the wall of the heat roll 22. This arrangement provides stable positioning of the sealing sheet 28 while also ensuring secure fixing of the retaining stays 29A and 29B to prevent deformation of the heat roll 22.

Further, although the embodiment depicted above shows the retaining stays 29A and 29B with the multiple oval through-holes 30A and 30B for use in combination with the reinforcing member 23 with the multiple flanges 23*a*, the configuration of the through-holes 30A and 30B may be other than those depicted in FIGS. 5A and 5B.

Figure 11A:
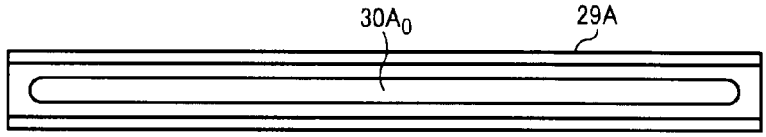
FIGS. 11A and 11B are front side views schematically illustrating still another embodiment of the first retaining stay and the second retaining stay.
Figure 11B:
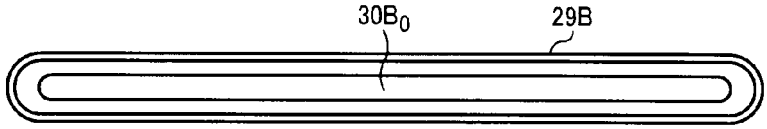

For example, as shown in FIGS. 11A and 11B, it is possible to provide the first and second stays 29A and 29B with single elongated slot-like through-holes $\mathbf{30}A_0$ and $\mathbf{30}B_0$, respectively, in which case the reinforcing member 23 may have a single convex flange with a smoothly curved surface, or with multiple planar facets approximating a curved surface.

It is, however, preferable to provide the retaining stays 29A and 29B each perforated with multiple through-holes as in the embodiments depicted primarily with reference to FIGS. 5A and 5B, for several practical reasons. One reason is that a multi-perforated retaining stay, having multiple connections between a pair of opposing sides, can efficiently transfer heat through from one side to the other compared to that possible with a single-perforated stay having only a pair of connections at its longitudinal ends. Capability for efficient heat transfer is particularly ideal for the first retaining stay 29A disposed adjacent to the heater 25 within the hollow heat roll 22, which would deform due to intense heating if accumulating heat where it is closest to the heater 25.

Another reason is that the multiple connections between the opposing sides of a multi-perforated stay result in consistently higher mechanical strength throughout the length of the retaining stay. Higher mechanical strength allows the retaining stays 29A and 29B to reliably retain the shape of the heat roll 22, and in particular, enables the second retaining stay 29B to securely fasten the sealing seat 28 to the walls of the heat roll 22 across the length of the roll opening 22*a*.

To sufficiently derive the high thermal transfer and strengthening effects of creating multiple through-holes, it is preferable to provide five or more through-holes to a retaining stay with a length of approximately 300 mm in the axial direction X (i.e., equivalent to the width of an A3-size copy sheet). Disposing multiple through-holes within the limited extent of a retaining stay is accomplished by arranging the configuration of the through-holes, with corresponding modification on the flanges 23*a* of the reinforcing member 23.

Figure 12:
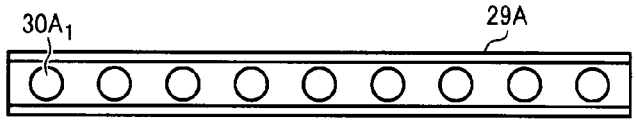
FIG. 12 is a front side view schematically illustrating still another embodiment of the first retaining stay for use in the fuser assembly of FIG. 4.

For example, as shown in FIG. 12, it is possible to provide the first stay 29A with a set of multiple relatively small circular through-holes 30$A_1$, and the second stay 29B with a set of similar through-holes 30$B_1$, not shown.

In this case, the reinforcing member 23 is provided with a set of multiple flanges relatively small and circular in cross-section arranged along the longitudinal axis to together define a smooth convex surface or such shape approximated by multiple planar surfaces.

Figure 13A:
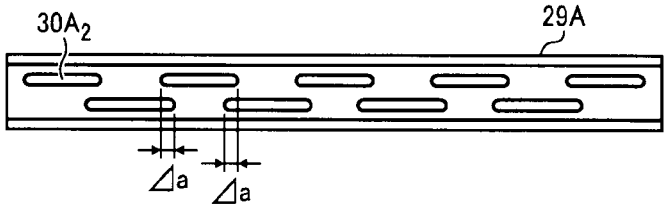
FIGS. 13A and 13B are front side views schematically illustrating yet still another embodiments of the first retaining stay for use in the fuser assembly of FIG. 4.
Figure 13B:
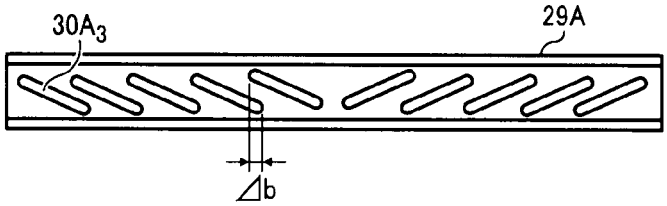

Further, as shown in FIG. 13A, it is also possible to provide the first stay 29A with a set of multiple alternating but parallel narrow through-holes 30$A_2$, arranged in two rows so that each through-hole overlaps adjacent through-holes by an amount Δa, and the second stay 29B with a set of similar through-holes 30$B_2$, not shown. Alternatively, as shown in FIG. 13B, it is also possible to provide the first stay 29A with a set of multiple diagonal narrow through-holes 30$A_2$, arranged in two symmetrical arrays about a transverse center so that each through-hole overlaps adjacent through-holes by an amount Δb, and the second stay 29B with a set of similar through-holes 30$B_2$, not shown.

In such cases, the reinforcing member 23 is provided with a set of multiple overlapping flanges arranged along the longitudinal axis, which translates into continuous contact between the reinforcing member 23 and the fuser pad 26 along the axial direction X to ensure uniform distribution of pressure across the fixing nip N.

In further embodiments, the fixing device 20 according to this patent specification may employ a partially open-sided cylindrical heat roll 122 instead of the open-sided heat roll 22.

Figure 14:
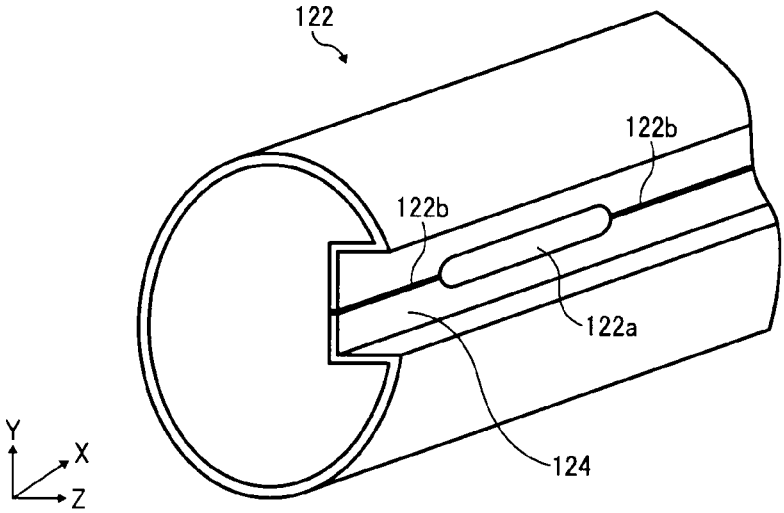
FIG. 14 is a perspective view schematically illustrating one example of a partially open-sided heat roll for use in the fixing device 20 of FIG. 2.

With reference to FIG. 14, which is a perspective view schematically illustrating one example of the partially open-sided heat roll 122 before assembly, the heat roll 122 comprises a generally cylindrical thin-walled hollow member with a substantially C-shaped cross-section, which has two longitudinal edges 122*b* turned inward toward an interior hollow and partially joining each other to form an elongated cavity 124 open to the hollow interior through one or more openings or gaps 122*a* defined between the inwardly turned longitudinal edges 122*b*.

Specifically, the close-sided heat roll 122 is prepared by bending a thin sheet of thermally conductive material into a rolled configuration, with two opposing edges turned inward and bent toward each other to define a letter "L" in cross-section, followed by bonding at least partially together the adjoining sheet ends, which are cut or perforated before or after the rolling process to form the side cavity 124 open to the roll hollow through the openings 122*a*. The roll wall edges 122*b* may be bonded through welding, gluing, or other suitable connecting process.

Figure 15:
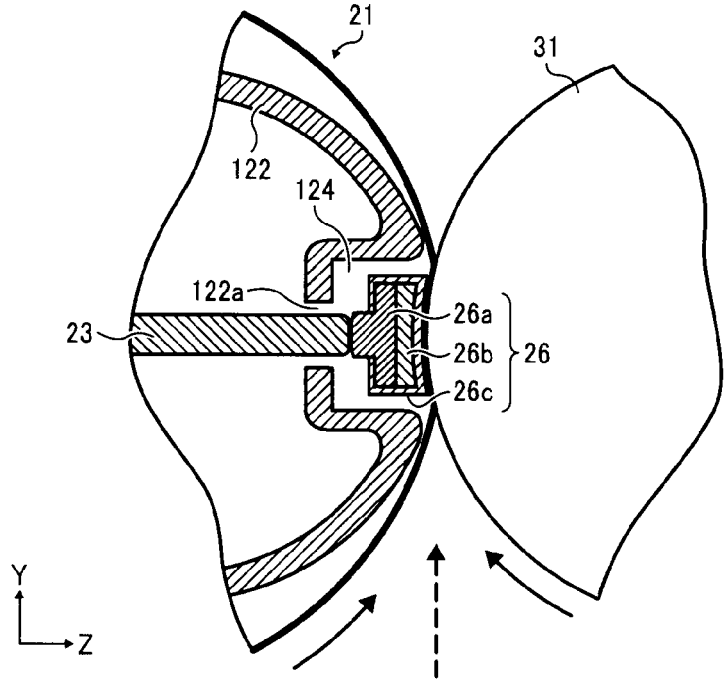
FIG. 15 is an enlarged, end-on, axial cutaway view illustrating in detail the fuser assembly assembled with the heat roll of FIG. 14.

With reference to FIG. 15, which is an enlarged partial cutaway end-on axial view of the fixing device 20 with the close-sided heat roll 122 during operation, the heat roll 122 is assembled with the reinforcing member 23 and the stationary member 26 as well as the fuser belt 21 and the pressure roller 31 to obtain the complete fixing device 20 in a manner similar to that described above.

Note that the heat roll 122 depicted in FIG. 15 is assembled without using additional retaining members, in contrast to the open-sided heat roll 22 using the retaining stays 29 to clamp together the open edges. This is because the heat roll 122 can retain the generally cylindrical concave-sided configuration by at least partially bonding together the side edges 122*b* of the roll wall, which have similar or identical effects as the mechanical retaining stays 29 of the open-sided heat roll 22. However, the close-sided heat roll 122 may be used in conjunction with the retaining stays 29, so as to facilitate handling of the rolled sheet during assembly particularly where the roll edges 122*b* are bonded only at two ends of the length of the roll so as to form an elongated single opening.

To recapitulate, the fixing device 20 according to this patent specification incorporates a fuser assembly employing the hollow, generally cylindrical open-sided stationary heat roll 22 in combination with the fuser pad 26 held substantially stationary along the roll opening 22*a* to receive pressure from the rotatable pressure member 31 through the fuser belt to form the fixing nip N along which a recording medium is passed to fix a toner image under heat and pressure, wherein the roll shape retainer 29 disposed on the roll opening 22*a* retains the generally cylindrical shape of the heat roll 22.

The fixing device 20 also has the reinforcing member 23 disposed within the roll hollow to thrust against the fuser pad 26 through the roll opening 22*a* for reinforcement purposes, wherein the roll shape retainer 29 has one or more through-holes 30 defined therein to allow contact between the reinforcing member 23 and the fuser pad 26 through the roll opening 22*a*.

Thus, the fixing device 20 according to this patent specification can operate with extremely short warm-up time and first print time required to process an initial print job at start-up, while exhibiting high immunity to failures caused by insufficient heating of the fuser belt in high speed application, owing to the thermally conductive heat roll 22 swiftly and uniformly heating the fuser belt 26. Moreover, the fixing device 20 allows use of an extremely thin-walled heat roll for obtaining high thermal efficiency, since the combined use of the heat roll 22 and the fuser pad 26 substantially isolates the heat roll 22 from pressure from the pressure roller 31, while the roll shape retainer 29 prevents springback or deformation of the heat roll 22 caused by elastic recovery of the thin sheet material after bending.

Although the several embodiments depicted above use the sealing sheet 28 disposed to cover the opening 22*a* of the heat roll 22, the heat roll assembly may be configured without sealing the roll opening 22*a*, where lubricating between the fuser belt 21 and the outer circumference of the heat roll 22 is accomplished by providing a low-friction coating of, for example, fluorine resin over the outer surface of the heat roll 22 instead of depositing a lubricating agent at the interface of the fuser belt 21 and the heat roll 22. In such cases, the reinforcing member 23 directly contacts the back of the fuser pad 26 through the openings defined in the walls of the first and second stays 29A and 29B retaining the cylindrical shape of the heat roll 22 from within and outside the roll hollow.

Figure 16:
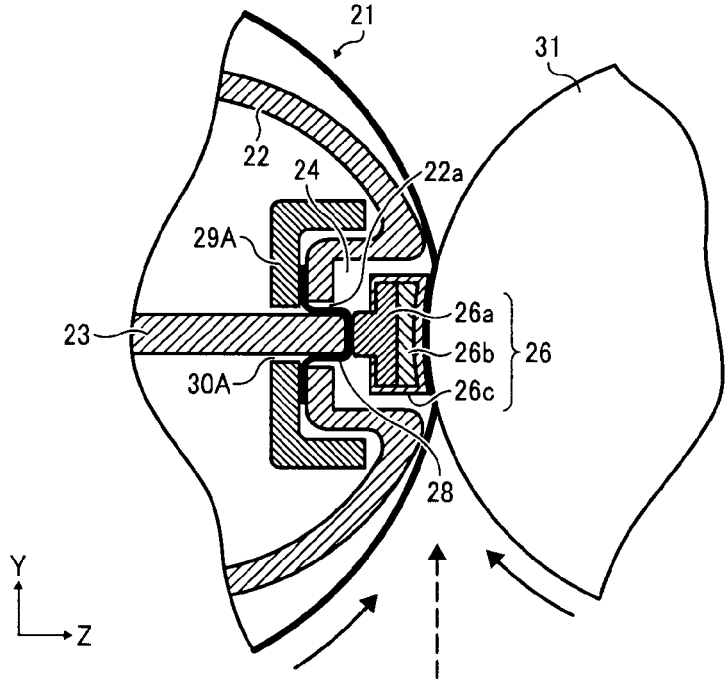
FIG. 16 is an enlarged, end-on, axial cutaway view illustrating in detail another embodiment of the fuser assembly for use in the fixing device 20 of FIG. 2.

Further, although the several embodiments depicted above use a pair of mechanical retaining stays to retain the generally cylindrical shape of the open-sided heat roll, the heat roll assembly may be configured with only a single mechanical stay disposed on the open concave side of the heat roll. For example, as shown in FIG. 16, providing only the first retaining stay 29A fitted over the side cavity 24 from inside the roll hollow may suffice to hold together the ends of the rolled sheet with appropriate configuration of the roll assembly. It is also possible to retain the heat roll shape by using only the second retaining stay 29B fitted over the side cavity 24 from outside the roll hollow, in which case the second stay 29B is secured to the roll walls by screwing or gluing.

Numerous additional modifications and variations are possible in light of the above teachings. For example, although the embodiments described above employ a pressure roller with its rotational axis held on a positioning mechanism, the fixing device according to this patent specification may be configured with any suitable rotatable body equipped with a biasing member, such as an endless belt looped for rotation around a certain supporting member, to press against the fuser pad to form a fixing nip.

Further, although the embodiments described above employ a multi-layered fuser belt formed of a substrate combined with elastic and releasing layers, the fixing device according to this patent specification may be configured with an endless belt or film of any suitable material, such as any one or combination of polyimide, polyamide, fluorine resin, and metal, looped for rotation around the heat roll while heated.

Furthermore, although the embodiments described above employ a radiation heater disposed in the hollow interior of the heat roll, the fixing device according to this specification may be configured with any suitable heating mechanism, such as an induction heater with an electromagnetic coil or an electrical resistance heater, mounted on or adjacent to the inner circumference of the heat roll.

It is therefore to be understood that, within the scope of the appended claims, the disclosure of this patent specification may be practiced otherwise than as specifically described herein.

What is claimed is:

1. A fixing device comprising:

a hollow, generally cylindrical open-sided stationary heat roll to heat an outer circumference thereof, the heat roll defining an elongated longitudinal side opening in one side thereof;

a flexible fuser belt looped for rotation around the heat roll to transfer heat radially outward from the roll circumference;

a fuser pad held substantially stationary along the roll opening outward from the roll hollow and inward from the loop of the fuser belt;

a rotatable pressure member pressed against the fuser pad through the fuser belt to form a fixing nip through which a recording medium is passed to fix a toner image under heat and pressure; and a roll shape retainer disposed on the roll opening to retain the generally cylindrical shape of the heat roll.

2. The fixing device according to claim 1, wherein the heat roll comprises an open concave-sided heat pipe with an elongated side cavity open to the interior hollow for accommodating the fuser pad therewithin, the heat pipe being formed by rolling a sheet of thermally conductive material with two opposing ends thereof bent inward and spaced away from each other to obtain the open side cavity defined between the opposing ends.

3. The fixing device according to claim 2, wherein the roll shape retainer comprises a mechanical stay that fits the side cavity either inside or outside the roll hollow to clamp together the opposing ends of the rolled sheet of thermally conductive material.

4. The fixing device according to claim 1, further comprising a reinforcing member disposed within the roll hollow that thrusts against the fuser pad through the roll opening for reinforcement, wherein the roll shape retainer has multiple through-holes defined therein to allow contact between the reinforcing member and the fuser pad through the roll opening.

5. The fixing device according to claim 4, wherein the through-holes of the roll shape retainer are positioned so as not to overlap side edges of a recording medium passing through the fixing nip.

6. The fixing device according to claim 4, wherein each through-hole of the roll shape retainer overlaps an adjacent retainer through-hole.

7. The fixing device according to claim 4, further comprising a sealing sheet disposed on the open side of the heat roll to close the roll opening, wherein the reinforcing member and the stationary pad contact each other through thickness of the sealing sheet.

8. The fixing device according to claim 4, wherein at least one of the reinforcing member and the fuser pad has one or more flanges inserted through the respective through-holes of the roll shape retainer to form a deformable contact surface directed to the other one of the reinforcing member and the fuser pad, the contact surface being convex under a no-load condition where there is substantially no pressure pressing the reinforcing member and the fuser pad against each other, and being substantially flat under a load condition where pressure is applied to press the reinforcing member and the fuser pad against each other.

9. The fixing device according to claim 8, wherein the flanges have planar facets defining a substantially continuous contact surface.

10. The fixing device according to claim 1, wherein the elongated side opening of the heat roll is at least partially closed.

11. A fixing device comprising:

a hollow, partially open-sided stationary heat roll to heat an outer circumference thereof, the heat roll being at least partially open to define a series of one or more side openings in one side thereof;

a flexible, fuser belt looped for rotation around the heat roll to transfer heat radially outward from the roll circumference;

a fuser pad held substantially stationary along the series of roll openings outward from the roll hollow and inward from the loop of the fuser belt;

a rotatable pressure member pressed against the fuser pad through the fuser belt to form a fixing nip through which a recording medium is passed to fix a toner image under heat and pressure; and a reinforcing member disposed within the roll hollow to thrust against the fuser pad through the series of roll openings for reinforcement.

12. The fixing device according to claim 11, wherein the heat roll is formed by rolling a sheet of thermally conductive material with two opposing ends thereof joining each other.

13. The fixing device according to claim 11, wherein the heat roll comprises a concave-sided heat pipe with an elongated side cavity partially open to the interior hollow through the series of side openings for accommodating the fuser pad therewithin, the heat pipe being formed by rolling a sheet of thermally conductive material with two opposing ends thereof bent inward and bonded together to obtain the side cavity defined between the opposing ends.

14. The fixing device according to claim 11, wherein the series of side openings of the heat roll are positioned so as not to overlap side edges of a recording medium passing through the fixing nip.

15. The fixing device according to claim 11, wherein each side opening of the heat roll overlaps an adjacent roll opening.

16. The fixing device according to claim 11, further comprising a sealing sheet disposed on the partially open side of the heat roll to close the roll openings, wherein the reinforcing member and the stationary pad contact each other through thickness of the sealing sheet.

17. The fixing device according to claim 11, wherein at least one of the reinforcing member and the fuser pad has one or more flanges inserted through the respective openings of the heat roll to form a deformable contact surface directed to the other one of the reinforcing member and the fuser pad, the contact surface being convex under a no-load condition where there is substantially no pressure pressing the reinforcing member and the fuser pad against each other, and being substantially flat under a load condition where pressure is applied to press the reinforcing member and the fuser pad against each other.

18. The fixing device according to claim 17, wherein the flanges have planar facets defining a substantially continuous contact surface.

19. An image forming apparatus, comprising:

an electrophotographic imaging unit to form a toner image on a recording medium; and a fixing device to fix the toner image in place on the recording medium, the fixing device including:

a hollow, generally cylindrical open-sided stationary heat roll to heat an outer circumference thereof, the heat roll defining an elongated longitudinal side opening in one side thereof;

a flexible, fuser belt looped for rotation around the heat roll to transfer heat radially outward from the roll circumference;

a fuser pad held substantially stationary along the roll opening outward from the roll hollow and inward from the loop of the fuser belt;

a rotatable pressure member pressed against the fuser pad through the fuser belt to form a fixing nip through which a recording medium is passed to fix a toner image under heat and pressure; and a roll shape retainer disposed on the roll opening to retain the generally cylindrical shape of the heat roll.

* * * * *